US011846126B2

(12) United States Patent
Yukin

(10) Patent No.: US 11,846,126 B2
(45) Date of Patent: Dec. 19, 2023

(54) MOTOR VEHICLE DOOR LATCH

(71) Applicant: Kiekert AG, Heiligenhaus (DE)

(72) Inventor: Liu Yukin, Jiangsu (CN)

(73) Assignee: Kiekert AG, Heiligenhaus (DE)

( * ) Notice: Subject to any disclaimer, the term of this patent is extended or adjusted under 35 U.S.C. 154(b) by 664 days.

(21) Appl. No.: 16/606,244

(22) PCT Filed: Apr. 3, 2018

(86) PCT No.: PCT/IB2018/000318
§ 371 (c)(1),
(2) Date: Oct. 18, 2019

(87) PCT Pub. No.: WO2018/193299
PCT Pub. Date: Oct. 25, 2018

(65) Prior Publication Data

US 2020/0123818 A1 Apr. 23, 2020

(30) Foreign Application Priority Data

Apr. 21, 2017 (CN) ..... 201710264757.5

(51) Int. Cl.
*E05B 85/04* (2014.01)
*E05B 79/08* (2014.01)
(Continued)

(52) U.S. Cl.
CPC ..... *E05B 85/04* (2013.01); *E05B 77/30* (2013.01); *E05B 79/08* (2013.01); *E05B 81/16* (2013.01); *E05B 77/28* (2013.01); *E05B 85/20* (2013.01)

(58) Field of Classification Search
CPC ..... E05B 77/28; E05B 77/30; E05B 81/16; E05B 81/06; E05B 81/34; E05B 81/20;
(Continued)

(56) References Cited

U.S. PATENT DOCUMENTS 6,116,664 A * 9/2000 Wegner ..... E05B 77/28 292/201
8,151,610 B2 * 4/2012 Fujihara ..... E05B 77/28 292/201
(Continued)

FOREIGN PATENT DOCUMENTS

DE 102005052190 A1 5/2007
DE 102012017286 A1 3/2014
(Continued)

OTHER PUBLICATIONS

International Search Report and Written Opinion for corresponding Patent Application No. PCT/IB2018/000318 dated Jun. 21, 2018.

*Primary Examiner* — Christine M Mills
*Assistant Examiner* — Yahya Sidky
(74) *Attorney, Agent, or Firm* — Renner, Otto, Boisselle & Sklar, LLP

(57) ABSTRACT

A motor vehicle door latch which is equipped with a locking mechanism fundamentally comprising a catch and a pawl, furthermore with an activation lever mechanism working on the locking mechanism with a coupling element. Furthermore, a bolting unit enabling/disabling the activation lever mechanism is provided for. Furthermore, a securing device interacting with the coupling element is executed which also enables/disables the activation lever mechanism. According to the invention, the securing device impinges the coupling element independently of the bolting unit for execution of the enabled/disabled position of the activation lever mechanism.

19 Claims, 5 Drawing Sheets

Figure 1:
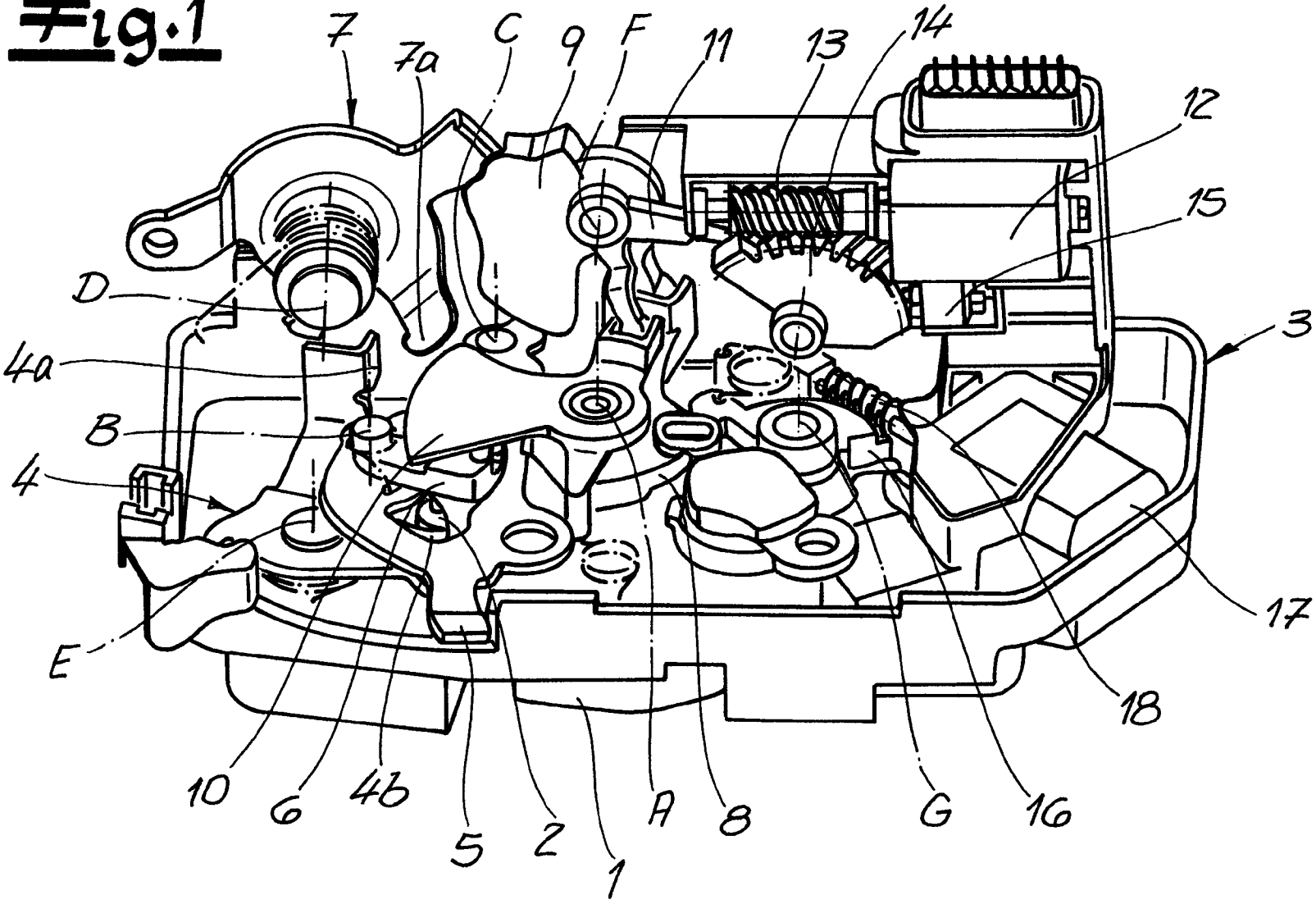

(51) Int. Cl.

| | |
|---|---|
| ***E05B 77/30*** | (2014.01) |
| ***E05B 81/16*** | (2014.01) |
| ***E05B 77/28*** | (2014.01) |
| ***E05B 85/20*** | (2014.01) |

(58) Field of Classification Search
CPC ..... E05B 81/00; E05B 81/04; E05B 85/20; E05B 79/08; Y10T 292/1082; Y10T 292/1047; Y10S 292/23
See application file for complete search history.

(56) References Cited

U.S. PATENT DOCUMENTS

| | | | | |
|---|---|---|---|---|
| 8,474,888 | B2 * | 7/2013 | Tomaszewski | E05B 77/30 292/216 |
| 2002/0011733 | A1 * | 1/2002 | Kunst | E05B 77/24 292/216 |
| 2014/0001778 | A1 * | 1/2014 | Yokomori | E05B 81/76 292/336.3 |

FOREIGN PATENT DOCUMENTS

| | | | |
|---|---|---|---|
| EP | 0826855 | A2 | 3/1998 |
| EP | 1335087 | A1 | 8/2003 |
| WO | 2007051176 | A2 | 5/2007 |

* cited by examiner

MOTOR VEHICLE DOOR LATCH

The invention relates to a motor vehicle door latch, with a locking mechanism fundamentally comprising a catch and a pawl, furthermore with an activation lever mechanism working on the locking mechanism with a coupling element and a bolting unit enabling/disabling the activation lever mechanism and with a securing device interacting with the coupling element, which also enables/disables the activation lever mechanism.

The activation mechanism generally works on the locking mechanism during its impingement in such a way that the pawl engaging with the catch is lifted by it. As a consequence hereof, the catch pivots open in a spring-assisted manner and releases a previously trapped locking bolt. This applies as long the activation lever mechanism functions or is enabled by the bolting unit or the securing device additionally provided for. The "unbolted" functional state of the bolting unit or the "unsecured" state of the securing device corresponds to this.

If, in contrast, the activation lever mechanism is in the disabled state, the activation lever mechanism is mechanically interrupted and can consequently not lift the pawl from the catch during impingement. The locking mechanism remains closed and the locking bolt is still trapped. The "bolted" functional position of the bolting unit or the "secured" position of the securing device correspond to this.

With a motor vehicle door latch according to EP 0 866 189 B1, a safety mechanism with a safety lever is generally provided for. The safety lever can be activated with the aid of a key and move backwards and forwards between its two conceivable positions, a blocking position and a release position. The safety mechanism essentially adopts the function of the previously described bolting unit.

With another motor vehicle door latch according to DE 10 2005 052 190 A1 a bolting unit with a pertaining bolting motor on the one hand and a securing device or theft/child securing device with its own theft/child securing motor is executed on the other hand. A coupling element impinged by a bolting element is also provided for. The coupling element assumes at least three different positions compared to an external activation lever chain or an internal activation lever chain. Thus, the internal activation lever chain, the external activation lever chain or both lever chains can optionally be activated/deactivated.

With a motor vehicle door latch according to the genre as described in DE 10 2012 017 286 A1, a bolting unit and a securing device optionally disabling/enabling the bolting unit are executed. The securing device is formed as a retrofitting module connectable to the basic module largely comprising the locking mechanism, the activation lever chain and the bolting unit where necessary. The retrofitting module has its own retrofitting module housing. Thus, different equipment variants should be provided according to actual requirements and in the attainment of significant cost benefits.

In the closest state-of-the-art according to DE 10 2012 017 286 A1 it is proceeded in such a way that the securing device there optionally enables/disables the activation lever chain and the bolting unit simultaneously. For this purpose, the securing device is equipped with an activation pin which engages on an edge of the coupling element. The securing device is therefore able to transfer the coupling element into a position coupling the activation lever chain with the bolting unit and into a position uncoupling these two elements. The initially stated functional position corresponds to the securing device being in its "Off" position. In contrast, the latterly stated functional position pertains to the "On" state of the securing device.

Thus, different equipment variants can be achieved according to requirements. However, there are functional states which cannot or practically cannot be implemented with the known motor vehicle door latch.

In fact, for example with lorries or lorry drivers there is a requirement to be able to unbolt or open and bolt the pertaining motor vehicle door from the inside. This means that external activation should optionally be prevented. Such a requirement is placed in particular on lorries or motor vehicles in general in which drivers sleep or wish to remain undisturbed overall. Although a motor vehicle door can typically also be bolted from the inside with the aid of the bolting unit. The motor vehicle door is then also bolted externally. In order to be able to open the motor vehicle door from the inside, unbolting is initially necessary during this procedure before the motor vehicle door latch is opened with an opening stroke or can be opened at all.

To this end, two stroke activations on an internal door handle are often necessary. This is viewed as lacking in convenience and also unsuitable if the driver wants to leave the motor vehicle hastily. This is where the invention is used.

The invention is based on the technical problem of developing such a motor vehicle door latch in such a way that a pertaining motor vehicle door can be reliably bolted at least from the outside and can nevertheless be opened easily, simply and quickly from the inside. In particular, this functionality should be able to be depicted independently of bolting.

In order to solve this technical problem, a class-specific motor vehicle door latch within the scope of the invention is characterized by the securing device impinging the coupling element independently of the bolting unit for execution of the enabling/disabling position of the activation lever mechanism.

According to an advantageous design, the safety device works solely on an external activation lever chain as a component of the activation lever mechanism. Typically, the activation lever mechanism comprises the external activation lever chain and an additional internal activation lever chain as a further component. The internal activation lever chain advantageously works at least independently of the safety device. In addition, it is usually provided for that the coupling element is formed as a component of the external activation lever chain. For this purpose, the coupling element may be pivotably accommodated in or on an external activation lever.

The securing device can therefore enable/disable the external activation lever chain in particular. This happens independently of the bolting unit. In other words, the securing device ensures that the external activation lever chain is disabled, for example, even if the bolting unit assumes its "unbolted" position. The pertaining motor vehicle door can therefore not be opened from the outside. Because the disabled external activation lever chain corresponds to accomplishing an empty stroke when an external door handle is impinged; however, the locking mechanism is not impinged.

As the internal activation lever chain works at least independently of the securing device, the relevant motor vehicle door easily and unchangedly opens from inside in the described scenario. Previous unbolting is explicitly not necessary. Because the bolting unit is in its "unbolted" position in the depicted example case.

Instead, it is sufficient to pivot an internal door handle to impinge the internal activation lever chain. Consequently, as a consequence hereof a mechanical connection to the locking mechanism is present over the internal activation lever chain and the locking mechanism is thus opened. Consequently, an operator can intuitively and directly open the motor vehicle door if necessary. Consequently, the motor vehicle can be left hastily, for example.

In order to execute this in detail, the securing device impinges the coupling element. The coupling element constitutes an external activation lever chain component. To this end, the coupling element is pivotably accommodated in an external activation lever. In order to disable the external activation lever chain with the aid of a securing device, it is consequently sufficient to pivot the coupling element into a position compared to the external activation lever in which no continuous mechanical connection is present from the external door handle to the locking mechanism.

The "disengaged" functional state of the coupling element and the "secured" functional state of the securing device corresponds to this. In contrast, the functioning position of the activation lever mechanism or the external activation lever chain corresponds to a continuous mechanical connection being observed from the external door handle to the locking mechanism. In this case, the coupling element is located in its "engaged" position and the securing device is "unsecured".

Generally, in this context the coupling element ensures that the pawl can be lifted from the catch during impingement of the external door handle in the enabled position of the activation lever mechanism or the external activation lever chain. The coupling element is then simultaneously in its "engaged" position. In contrast, the "disengaged" functional position of the coupling element pertains to the situation that the coupling element cannot lift the pawl from the catch during impingement of the external activation lever chain. Activation of the external activation lever chain consequently comes to nothing.

Within the scope of the invention, the design is such that the securing device can impinge the coupling element and also the bolting element independently of one another. However, the priority is assigned to the bolting unit. Therefore as long as, for example, the bolting unit in its "bolted" position has transferred the coupling element into the "disengaged" state, the securing device cannot transfer the coupling element into the "engaged" functional position. The specifications of the bolting unit consequently take precedence which is why priority is assigned to the bolting unit. This applies at least to the "bolted" position of the bolting unit. Furthermore, this not only applies to the external activation lever chain, but also to the internal activation lever chain and consequently the activation lever mechanism as a whole.

However, the securing device is generally used if the bolting unit is in its "unbolted" position. Because then an opening of the pertaining motor vehicle door from the inside does not require an upstream unbolting step. In the "unbolted" position of the bolting unit the securing device now ensures that the coupling element is impinged independently of the bolting unit for execution of the disabled/enabled position of the activation lever mechanism. Specifically, in general this means that the securing device can transfer the external activation lever chain into the desired "disabled/enabled" position. In the functioning position, the motor vehicle door can be easily opened internally and externally with the aid of the relevant internal door handle or the external door handle.

However, if the securing device ensures that the coupling element has been impinged to the disabled position of the activation lever mechanism or the external activation lever chain in its "secured" position and consequently assumes the "disengaged" position, the pertaining motor vehicle door can no longer be opened from the outside. Consequently, corresponding impingement of the external door handle will come to nothing.

As the securing device only works on the external activation lever chain and in contrast the internal activation lever chain functions independently of the securing device, external activations of the motor vehicle door are thus, as requested, not permitted ; in contrast, the pertaining motor vehicle door can still be opened with unchanged ease from the inside. This is in particular a special advantage if a motor vehicle occupant wants to leave the pertaining motor vehicle hastily.

The securing device is generally equipped with at least a lever or securing lever impinging the coupling element. With the aid of this lever, the coupling element can consequently be transferred into the two "engaged" and "disengaged" positions. The first stated functional position corresponds to the external activation lever chain working and the securing device being "unsecured". In contrast, the disabled state of the external activation lever chain corresponds to the "uncoupled" position of the coupling element. The securing device is "secured".

According to a further advantageous design, the securing device demonstrates pivotable and mechanically coupled levers in two essentially vertical planes. The securing device can be impinged manually and automatically. Naturally, combined impingements are also conceivable. In order to execute the independent functioning of the securing device from the bolting unit, it is further provided for that the securing device and the bolting unit impinge the coupling element in parallel and independently. However, the bolting unit is still prioritized, at least with regard to its "bolted" position.

In this context, it is also provided for that a securing lever of the securing device and a bolting lever of the bolting unit are accommodated coaxially. The securing lever and the bolting lever can impinge the coupling element independently of one another. The coupling element is pivoted compared to the external activation lever for the transition from the "engaged" position to the "disengaged" position.

Finally, the securing device can also be formed on the basis of its independent configuration compared to the bolting unit in a subsequently incorporable manner or as a construction unit independent of the motor vehicle door latch and be used if necessary. This means that the securing device is designed to be retrofitted. Thus, an otherwise unchanged motor vehicle door latch is equipped with the outlined additional function which improves comfort and takes into account specific requirements of lorries in particular. In fact, the securing device gives the option of bolting a pertaining motor vehicle door independently of the bolting unit, at least from the outside. The pertaining motor vehicle door must still be opened from the inside. Consequently, a motor vehicle occupant can quickly and easily leave the relevant motor vehicle or driver's cabin. Herein lie important advantages of the invention.

Figure 2:
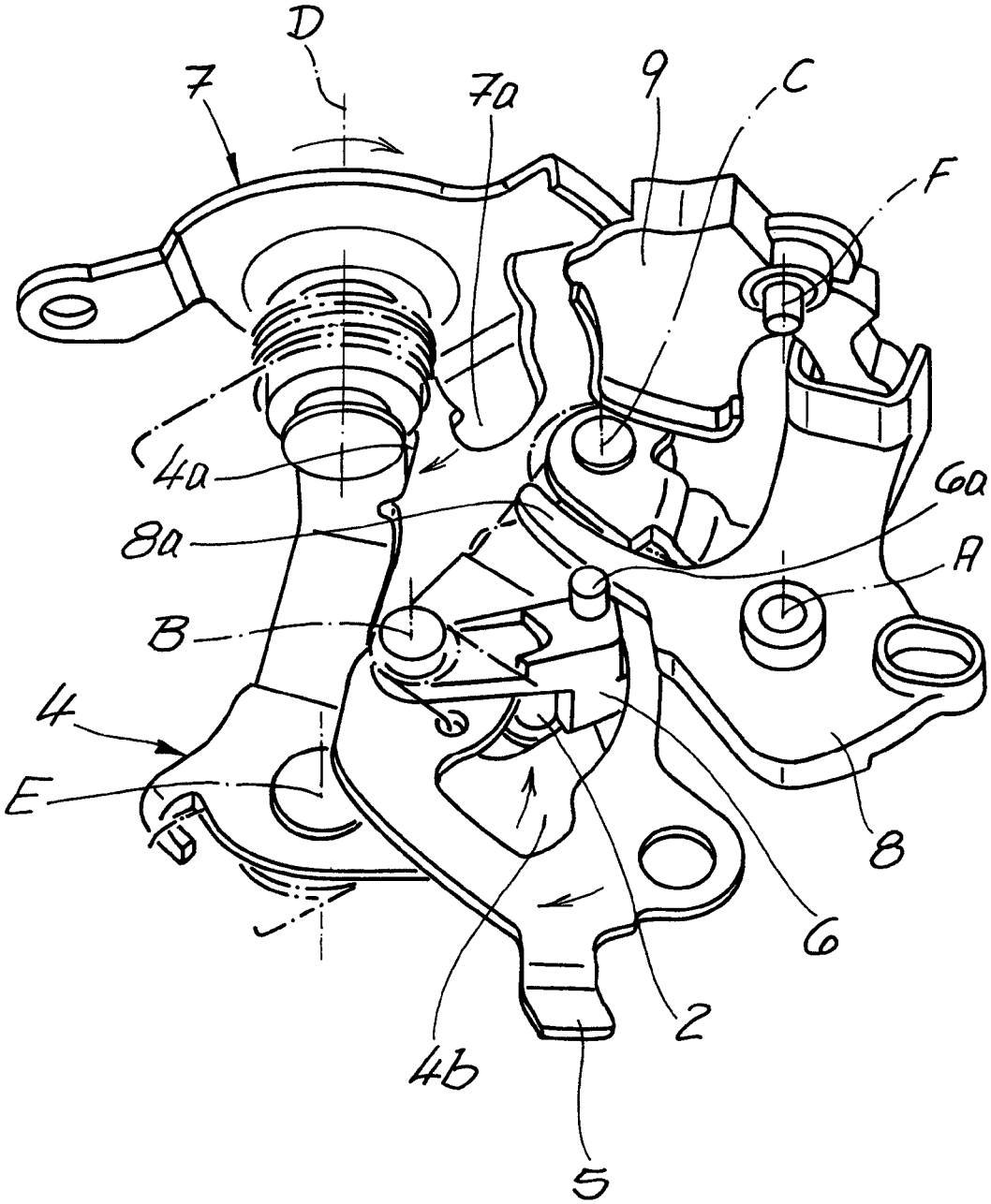
Figure 3:
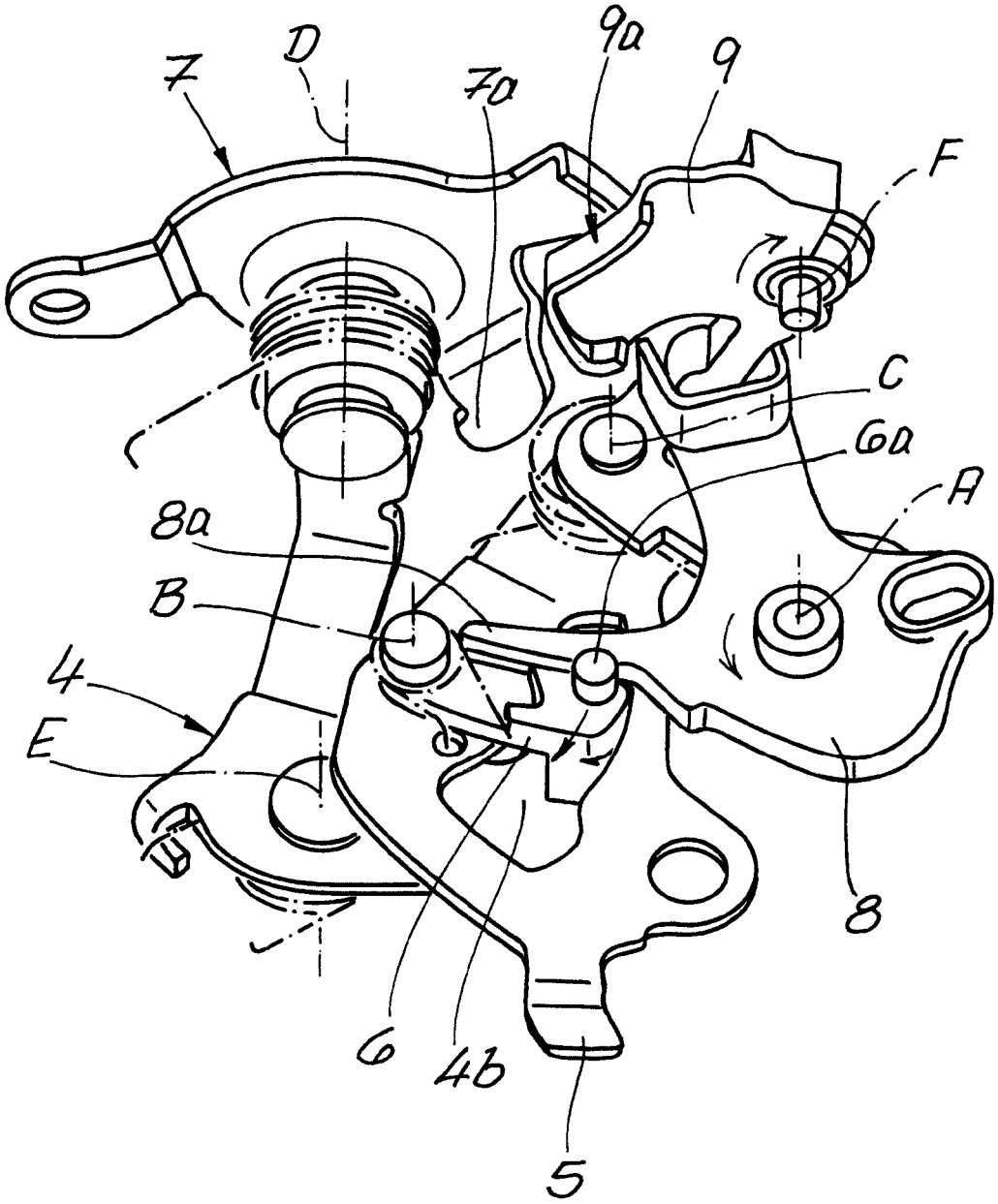
Figure 4:
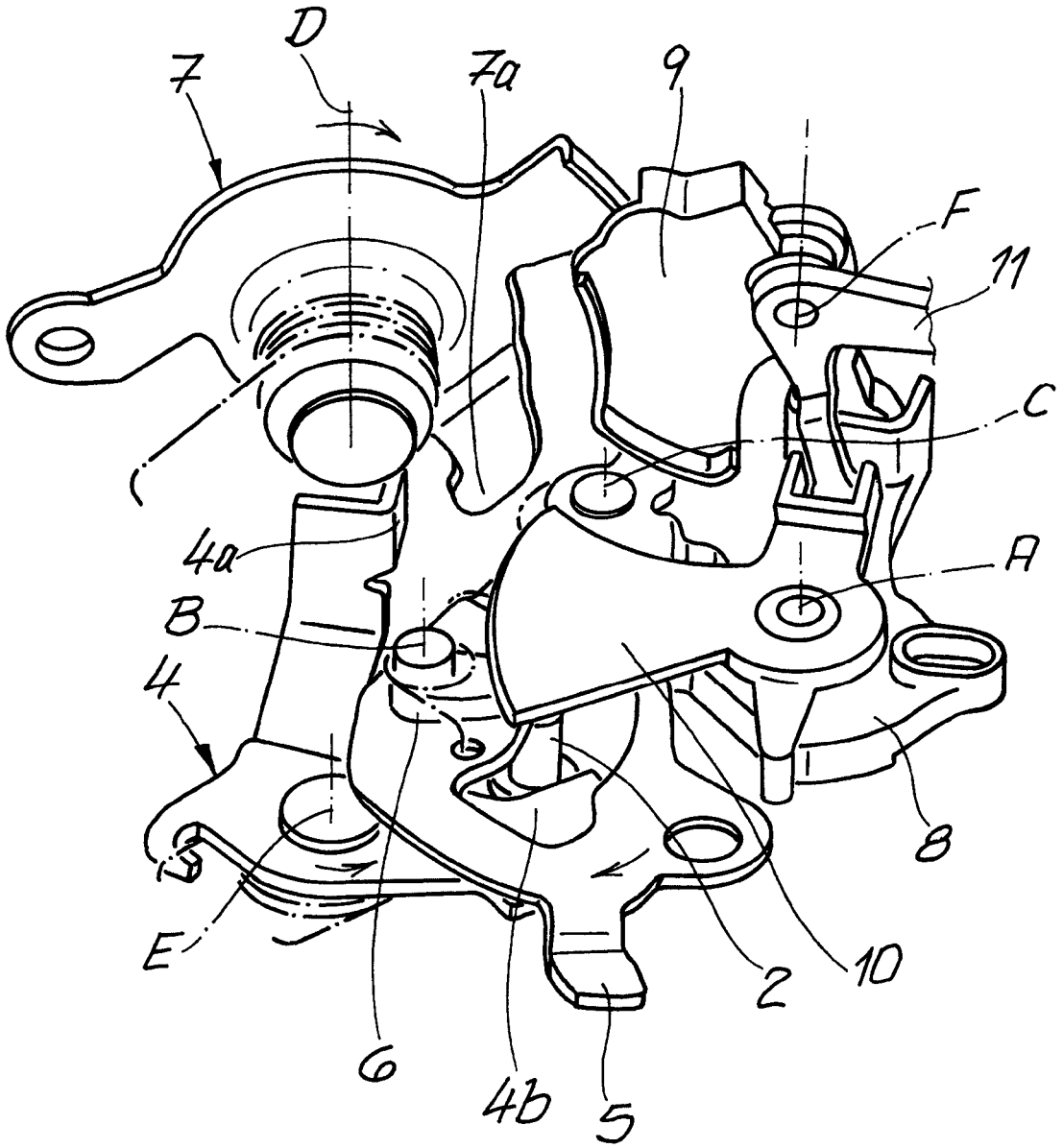
Figure 5:
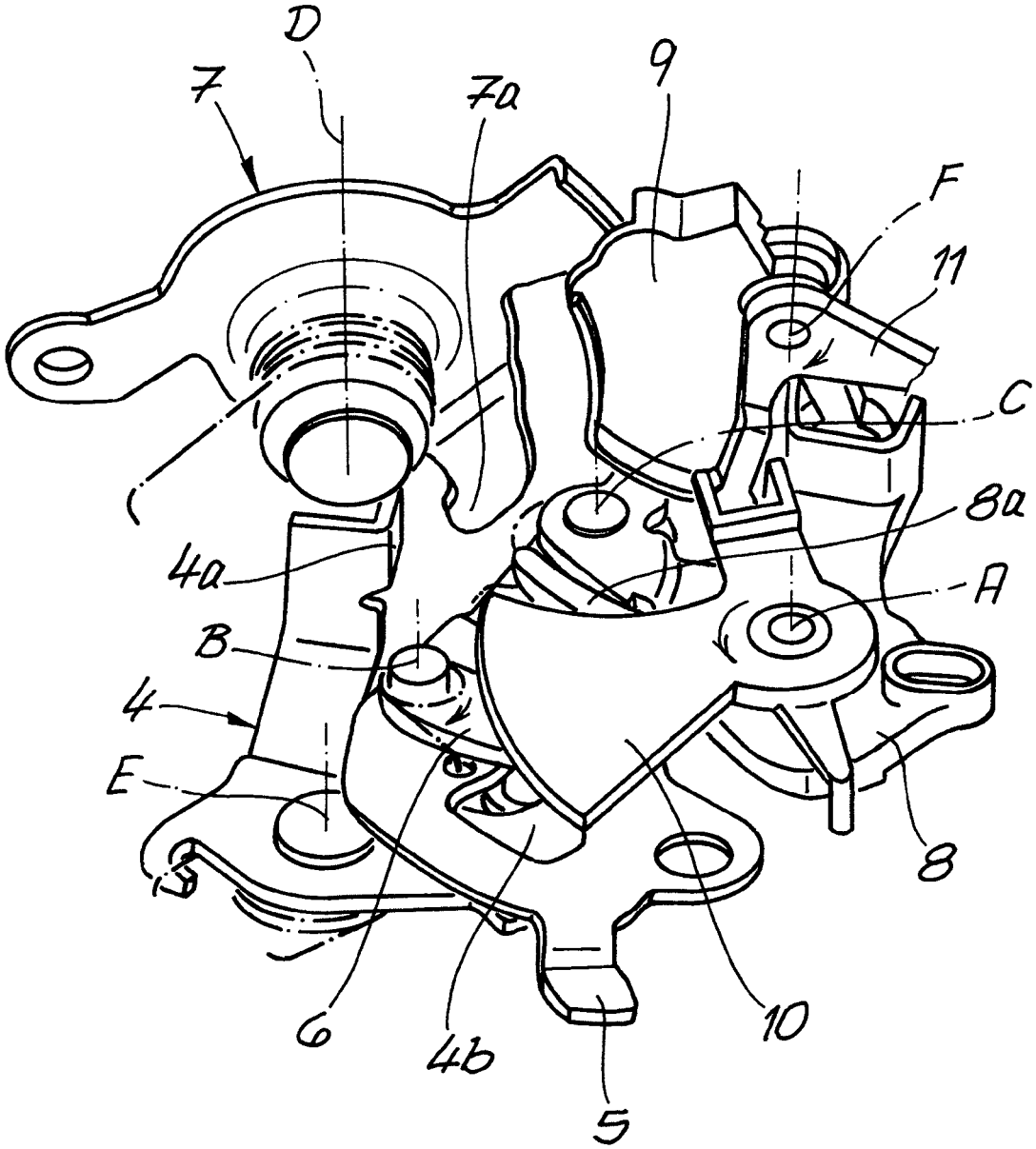

Hereinafter, the invention is explained in further detail on the basis of a sketch which only depicts an execution example. It shows:

FIG. 1 a perspective overview of the motor vehicle door latch according to the invention, FIG. 2 the motor vehicle door latch according to FIG. 1 in a section with the securing device removed in the "unbolted" position of the bolting unit, FIG. 3 the motor vehicle door latch according to FIG. 2 in the "bolted" functional state of the bolting unit, FIG. 4 the motor vehicle door latch according to FIG. 1 with integrated or available securing device in its "unsecured" position and FIG. 5 the object according to FIG. 4 with the securing device in its "secured" position.

In FIG. 1 a motor vehicle door latch is depicted perspectively and in an overview.

The motor vehicle door latch possesses a locking mechanism 1, 2 which is equipped with a catch 1 only recognizable in FIG. 1 and a pawl 2 to be recognized to some extent in FIGS. 2 and 4 on the basis of a pin. The locking mechanism 1, 2 is arranged in a plane below a depicted latch housing 3 in which the elements described below are incorporated in a protective manner.

In fact, the motor vehicle door latch possesses an activation lever mechanism 4, 5, 6, 7 working on the locking mechanism 1, 2 and arranged in the housing 3. The activation lever mechanism 4 to 7 comprises a triggering lever 4, an external activation lever 5, a coupling element 6 and finally an internal activation lever 7. The internal activation lever 7 and the triggering lever 4 together define an internal activation lever chain 4, 7. The external activation lever 5 and the coupling element 6 form an external activation lever chain 5, 6 in contrast.

Furthermore, a bolting unit 8, 9, 16, 17, 18 is recognized in the perspective depiction according to FIG. 1. The bolting unit 8, 9, 16, 17, 18 is equipped with an external bolting lever 8 and a vertically arranged internal bolting lever 9.

Furthermore, a drive 16, 17, 18 is still apparent for the external bolting lever or central bolting lever 8. The external bolting lever 8 is pivotably accommodated in the housing 3 around an axis A. With the aid of the drive 16, 17, 18 the external bolting lever 8 can be relevantly impinged to execute rotational movements compared to axis A. This can be seen in the transition from FIG. 2 to FIG. 3.

In fact, the external bolting lever 8 is depicted in the "unbolted" state in FIG. 2. In order to transfer the external bolting lever 8 into the "bolted" position according to the reproduction in FIG. 3, the external bolting lever 8 is pivoted around the axis A with the aid of the drive 16, 17, 18 in a counterclockwise direction as apparent in the transition from FIG. 2 to FIG. 3. In this process, the external bolting lever 8 impinges the coupling element 6. In fact, the coupling element 6 is accommodated on the external activation lever 5, pivotably around an axis B.

As soon as the external bolting lever 8 now executes the described pivoting movement around its axis A in a counterclockwise direction, a boom 8a on the external bolting lever 8 ensures that it pivots the coupling element 6 in a clockwise direction around its axis B by adjacency on a pin of the coupling element 6.

The "unbolted" position according to FIG. 2 corresponds to the "engaged" state of the coupling element 6. In contrast, the "disengaged" functional position of the coupling element 6 corresponds to the "bolted" position according to FIG. 3.

If the motor vehicle door latch is in the "unbolted" position according to the illustration in FIG. 2, the external activation lever 5 can thus be impinged in the direction of the arrow in the direction depicted in FIG. 2. A pivoting movement of the external activation lever 5 around its axis C in a clockwise direction corresponds to this. As the coupling element 6 has assumed its "engaged" position in the "unbolted" position in FIG. 2, the coupling element 6 can impinge the pin apparent in FIG. 2 on the pawl 2. As a consequence hereof, the pawl 2 engaged in the catch 1 is lifted from the catch 1. The catch 1 opens in a spring-assisted manner and a previously trapped locking bolt is released. The pertaining motor vehicle door can be opened from the outside. Because the external activation lever 5 is impinged with the aid of a non-illustrated external door handle.

If, in contrast, the motor vehicle door latch is in the "bolted" position according to FIG. 3, the external bolting lever 8 has thus previously pivoted the coupling element 6 with its jib 8a on transition from FIG. 2 to FIG. 3 around the pertaining axis B in a clockwise direction. Accordingly, the coupling element 6 assumes its "disengaged" position in the "bolted" position according to FIG. 3. If now in this functional position the external activation lever 5 is again impinged so that it executes a clockwise direction movement around its axis C, the coupling element 6 is disengaged with the upper pin of the pawl 2. Impingement of the external door handle consequently comes to nothing in relation to the locking mechanism 1, 2 and the locking mechanism 1, 2 cannot be opened.

The previous observations and considerations involve the external activation lever chain 5, 6 with the external activation lever 5 and the coupling element 6 pivotably accommodated around the axis B on the external activation lever 5. The following applies to the internal activation lever chain 4, 7. If the motor vehicle door latch is in the "unbolted" position according to FIG. 2, the internal activation lever 7 can thus be pivoted around its axis D in a clockwise direction in this position. As a consequence hereof, a jib 7*a* of the internal activation lever 7 touches an edge 4*a* of the triggering lever 4. Thus, the triggering lever 4 is pivoted around its axis E in a counter-clockwise direction. The counter-clockwise direction movement of the triggering lever 4 leads to the triggering lever 4 impinging or being able to impinge the elevated pin of the pawl 2 with a jib 4*b* in such a way that the pawl 2 is lifted from the catch 1. This means that in the "unbolted" position according to FIG. 2 the motor vehicle door latch can be opened both internally and externally by the relevant external activation lever chain 5, 6 being relevantly impinged with the external door handle or the internal activation lever chain 4, 7 with an internal door handle which is also not illustrated.

However, in the "bolted" position of the motor vehicle door latch according to FIG. 3, a pivoting movement of the internal activation lever 7 around its axis D in a clockwise direction is blocked. The internal bolting lever 9 serves this purpose. In fact, the internal bolting lever 9 is accommodated in a plane vertical compared to the external bolting lever 8 within the housing 3. As soon as the external bolting lever 8 goes into its "bolted" position according to FIG. 3 during transition from the "unbolted" position according to FIG. 2, the external bolting lever 8 is pivoted around its axis A in a counter-clockwise direction as described.

As the internal bolting lever 9 is mechanically coupled via a pin engaging into a pouch of the external bolting lever 8, the internal bolting lever 9 in the depicted counter-clockwise direction movement of the external bolting lever 8 around the axis A also undertakes a pivoting movement during transition from FIG. 2 to FIG. 3 in a clockwise direction around its axis F. As a result of the rotation in a clockwise direction of the internal bolting lever 9 a stop edge 9a arranged thereon engages with the internal activation lever 7 on its activation. Consequently, an impingement of the internal door handle and thus the internal activation lever 7 around its axis D in a clockwise direction in this case does not (no longer) lead to the internal activation lever 7 with its jib 7*a* reaching or being able to reach the stop edge 4*a* of the triggering lever 4. The locking mechanism 1, 2 consequently remains closed.

The drive 16, 17, 18 of the bolting unit 8, 9, 16, 17, 18 comprises a worm gear 16, a worm 18 impinging the worm gear 16 and finally a drive motor 17 which impinges the worm 18 on the output side. Rotations of a pinion shaft of the motor 17 lead to the worm 18 rotating around its longitudinal axis. As a consequence hereof, the worm gear 16 is also pivoted around its axis G. As the worm gear 16 is mechanically connected to the external bolting lever 8, relevant pivoting movements of the worm gear 16 lead to the external bolting lever 8 being able to execute the movements depicted with reference to FIGS. 2 and 3.

As already explained, the activation lever mechanism 4, 5, 6, 7 works on the locking mechanism 1, 2 which comprises the internal activation lever chain 4, 7 and the external activation lever chain 5, 6. The bolting unit 8, 9, 16, 17, 18 ensures that the activation lever mechanism 4, 5, 6, 7 is disabled and enabled. In a disabled state, the activation lever mechanism 4, 5, 6, 7 cannot open the locking mechanism 1, 2. To this end, the "bolted" position of the bolted unit 8, 9, 16, 17, 18 corresponds to this. In contrast, the "enabled" position of the activation lever mechanism 4, 5, 6, 7 corresponds to this in such a way that the bolting unit 8, 9, 16, 17, 18 is in its "unbolted" position as described.

A securing device 10, 11, 12, 13, 14, 15 is also present in addition to the bolting unit 8, 9, 16, 17, 18. With the aid of the securing device 10, 11, 12, 13, 14, 15 provided for according to the invention the activation lever mechanism 4, 5, 6, 7 can also be enabled/disabled - as with the aid of the bolting unit 8, 9, 16, 17, 18. For this purpose, the securing device 10, 11, 12, 13, 14, 15 impinges the coupling element 6 independently of the bolting unit 8, 9, 16, 17, 18 for execution of the disabled/enabled position of the activation lever mechanism 4, 5, 6, 7.

In the specific execution example, the securing device 10, 11, 12, 13, 14, 15 possesses a securing lever 10. In particular on the basis of the illustration in FIG. 1, it is apparent that the securing lever 10 and the previously discussed bolting lever or external bolting lever 8 are accommodated coaxially. Because both levers 8, 10 are pivotably accommodated in relation to the common axis A in the latch housing 3.

The securing device 10, 11, 12, 13, 14, 15 is furthermore equipped with a further lever 11. The lever 11 and the securing lever 10 are pivotably accommodated in two crucially vertical planes. It is apparent that the further second lever 11 of the securing device 10, 11, 12, 13, 14, 15 is accommodated coaxially to the internal bolting lever 9 on the common axis F. Furthermore, a drive 12, 13, 14 for the securing device 10, 11, 12, 13, 14, 15 works on the second lever 11 of the securing device 10, 11, 12, 13, 14, 15.

The drive 12, 13, 14 has a motor or electromotor 12, the pinion shaft of which bears a worm 13 driven by it. In turn, the worm 13 combs with a worm gear 14, the primary function of which is to pivot the bolting lever 11 and trigger a switch which can be impinged by the worm gear 14 or a general sensor 15. With the aid of the sensor 15 the functional position of the securing device 10, 11, 12, 13, 14 can be queried for the purpose of the enabled/disabled state. Furthermore, the worm gear 14 ensures that the second lever 11 can be pivoted around its axis F.

If FIGS. 4 and 5 are now viewed, the motor vehicle door latch is in the "enabled" position of the activation lever mechanism 4, 5, 6, 7 in the illustration according to FIG. 4. The securing device 10, 11, 12, 13, 14, 15 is "unsecured". Specifically and in the illustrated example, the securing device 10, 11, 12, 13, 14, 15 only works on the external activation lever chain 5, 6. In contrast, the internal activation lever chain 4, 7 still functions independently of the securing device 10, 11, 12, 13, 14, 15. In the functional position according to FIG. 4 the bolting unit 8, 9, 16, 17, 18 is located in its "unbolted" position as previously dealt with in reference to FIG. 2. The securing device 10, 11, 12, 13, 14, 15 corresponds to the "enabled" position of the activation lever mechanism 4, 5, 6, 7 or the external activation lever chain 5, 6.

The coupling element 6 hereby assumes its "engaged" position. Consequently, an impingement of the external activation lever 5 in a clockwise direction around its axis C corresponds to the coupling element 6 pivotably accommodated on the external activation lever 5 in the engaged position is being able to work on the elevated pin of the pawl 2. The pawl 2 is consequently lifted from the catch 1 and the catch 1 opens in a spring-assisted manner. Consequently, the previously trapped locking bolt is released. The pertaining motor vehicle door can consequently be opened externally. As the bolting unit 8, 9, 16, 17, 18 assumes its "unbolted" position according to the illustration in FIG. 2, the locking mechanism 1, 2 can be opened, also with the aid of the internal activation lever chain 4, 7, independently of this. To this end, it is only necessary for the internal activation lever 7 to be pivoted around its axis D in a clockwise direction and thus to be able to work on the triggering lever 4 as described with reference to FIG. 2. The triggering lever 4 impinges the elevated pin of the pawl 2, comparably to the coupling element 6, enabling the locking mechanism 1, 2 to be opened.

If now, starting from the functional position according to FIG. 4, the drive 12, 13, 14, 15 for the securing device 10, 11, 12, 13, 14, 15 is impinged, the worm gear 14 thus works on the second lever 11 in such a way that the second lever 11 is pivoted around its axis F in a clockwise direction in the transition from FIG. 4 to FIG. 5. The bolting unit 8, 9, 16, 17, 18 is unaffected by this as the second lever 11 is accommodated coaxially in relation to the common axis F with the internal bolting lever 9, but both levers 9, 11 can be pivoted independently of one another around the stated axis F. If the second lever 11 of the securing device 10, 11, 12, 13, 14, 15 now executes the described clockwise direction movement around its axis F during the transition from FIG. 4 to FIG. 5, the second lever 11 takes the securing lever 10 along here. Because the second lever 11 engages into a pouch of the securing lever 10 with its arm. The described clockwise direction movement of the second lever 11 now leads to the securing lever 10 being pivoted around its axis A in a counter-clockwise direction during the transition from FIG. 4 to FIG. 5.

In this case too, the counter-clockwise direction movement of the securing lever 10 around its common axis A with the external bolting lever 8 does not lead to the external bolting lever 8 being impacted in any way. Instead, the securing device 10, 11, 12, 13, 14 works completely independent of and detached from the bolting element 8, 9, 16, 17, 18.

As a result of the counter-clockwise direction movement of the securing lever 10 around its axis A, a not explicitly illustrated contour provided for below the securing lever 11 and becomes adjacent on the pin 6a of the coupling element 6 to be recognized in particular in FIGS. 2 and 3. The relevant contour below the securing lever 10 in this case ensures comparably to the jib 8a of the external bolting lever 8 during transition from FIG. 2 to FIG. 3 that the coupling element 6 is transferred from its "engaged" position according to the illustration in FIG. 4 into the "disengaged" position according to FIG. 5. As consequence of this, of the external door handle accomplishes nothing. Because this corresponds to the external activation lever 5 being pivoted around its axis C in a clockwise direction. The external activation lever 5 takes along the pivotably accommodated coupling element 6 in axis B. As the coupling element 6 is in the "disengaged" position, in this process it can no longer interact with the elevated pin of the pawl 2. The external door handle is in this case set out of function.

If, in contrast, the internal door handle is impinged, the motor vehicle door can easily be opened and without prior unbolting. Because the internal activation lever chain 4, 7 is impinged to this end which functions and is designed independently of the securing device 10, 11, 12, 13, 14, 15. In fact, impingement of the internal activation lever 7 in the "disabled" position according to FIG. 5 of the external activation lever chain 5, 6 leads to the internal activation lever 7 being able to be pivoted around its axis D in a clockwise direction because the pivoting movement is not impeded contrary to the "bolted" illustration according to FIG. 3. As a consequence hereof, the jib 7*a* of the internal activation lever 7 becomes engaged with the edge 4*a* of the triggering lever 4 in such a way that the triggering lever 4 is pivoted overall around its axis E in a counter-clockwise direction. The jib 4*b* of the triggering lever 4 can thus impinge the elevated pin of the pawl 2 and lift the pawl 2 from the catch 1. The locking mechanism is opened as requested.

This means that the securing device 10, 11, 12, 13, 14, 15 works according to the execution example solely on the external activation lever chain 5, 6. In contrast, the internal activation lever chain 4, 7 is designed independently of the securing device 10, 11, 12, 13, 14, 15. In addition to the motorized impingement of the securing device 10, 11, 12, 13, 14, 15 with the aid of the drive 12, 13, 14, it is naturally also possible to alternatively or additionally impinge the securing device 10, 11, 12, 13, 14, 15 manually. To this end, it is only necessary for the second lever 11 to be manually impinged in such a way that it performs the described clockwise direction movement around its axis F in the transition from FIG. 4 to FIG. 5.

Furthermore, on the basis of the above explanations it has become clear that the securing device 10, 11, 12, 13, 14, 15 and the bolting unit 8, 9, 16, 17, 18 impinge the coupling element 6 in parallel to one another and independently of one another. For this purpose, both the external bolting lever 8 and the securing lever 10 accommodated around the common axis A work independently of one another on the coupling element 6. However, priority is assigned to the bolting unit 8, 9, 16, 17, 18 overall.

Because when the bolting unit 8, 9, 16, 17, 18 is located in its "bolted" position according to the illustration in FIG. 3 and consequently the external bolting lever 8 with its jib 8a impinges the pin 6a of the coupling element 6, the securing lever 10 cannot transfer the coupling element 6 from the "disengaged" position then assumed into the "engaged" position. In fact, in this case the design is such that the securing device 10, 11, 12, 13, 14, 15 retains and needs to retain its "disabled" position of the activation lever mechanism 4, 5, 6, 7 or the internal activation lever chain 4, 7 or "secured" according to the illustration corresponding to FIG. 3 in FIG. 5. Because it can be queried with the aid of the sensor or switch 15. A motorized impingement of the securing device 10, 11, 12, 13, 14, 15 would therefore not lead to an opening of the locking mechanism 1, 2 in this case.

However, it is generally proceeded in such a way that the securing device 10, 11, 12, 13, 14, 15 only operates and can impinge the coupling element 6 as described when the bolting unit 8, 9, 16, 17, 18 is in the "unbolted" state. This can also be queried with the aid of a non-illustrated sensor assigned to the bolting unit 8, 9, 16, 17, 18.

The invention claimed is:

1. A motor vehicle door latch comprising:

a locking mechanism comprising a catch and a pawl;

an activation lever mechanism having a coupling element and a triggering element, wherein the triggering element acts on the pawl to lift the pawl from the catch to unlock the locking mechanism, wherein the triggering element is movably connected to an internal door handle of the motor vehicle door, and wherein the coupling element further acts on the pawl to lift the pawl from the catch to unlock the locking mechanism, wherein the coupling element is movably connected to an external door handle of the motor vehicle;

a bolting unit for enabling/disabling the activation lever mechanism, wherein the bolting unit simultaneously enables/disables the triggering element from acting on the pawl and the coupling element from acting on the pawl; and a securing device, wherein the securing device interacts with the coupling element to enable/disable the coupling element from acting on the pawl independently of the bolting unit such that when the bolting unit enables the activation lever mechanism, the securing device disables the coupling element from acting on the pawl by impinging the coupling element while enabling the triggering element to lift the pawl from the catch without requiring two-stroke activation of the triggering element to enable unlatching of the locking mechanism by way of the internal door handle while disabling unlatching of the locking mechanism by way of the external door handle.

2. The motor vehicle door latch according to claim 1, wherein the activation lever mechanism includes an external activation lever chain, wherein the securing device only acts on the external activation lever chain.

3. The motor vehicle door latch according to claim 2, wherein the coupling element is formed as a component of the external activation lever chain.

4. The motor vehicle door latch according to claim 3, wherein the coupling element is pivotably accommodated in or on an external activation lever in the external activation lever chain.

5. The motor vehicle door latch according to claim 1, wherein the activation lever mechanism includes an internal activation lever chain that is operable independently of the securing device.

6. The motor vehicle door latch according to claim 1, wherein the securing device has at least a securing lever that impinges the coupling element.

7. The motor vehicle door latch according to claim 1, wherein the securing device includes two pivotable, mechanically connected levers in vertical planes.

8. The motor vehicle door latch according to claim 1, wherein the securing device is impingeable against the coupling element when the bolting unit is in an unbolted state.

9. The motor vehicle door latch according to claim 1, wherein the securing device and the bolting unit are configured to impinge the coupling element in planes that are parallel to one another and independently of one another.

10. The motor vehicle door latch according to claim 9, wherein a securing lever of the securing device and a bolting lever of the bolting unit are accommodated coaxially.

11. The motor vehicle door latch according to claim 1, wherein the activation lever mechanism further includes an external activation lever and an internal activation lever.

12. The motor vehicle door latch according to claim 1, wherein the bolting unit includes an external bolting lever and an internal bolting lever.

13. The motor vehicle door latch according to claim 1, wherein the bolting unit includes a drive having a worm gear, a worm that impinges the worm gear, and a drive motor that impinges the worm.

14. The motor vehicle door latch according to claim 1, wherein the bolting unit has an external bolting lever that pivots the coupling element when the motor vehicle door latch is in a bolted position.

15. The motor vehicle door latch according to claim 14, wherein when the motor vehicle door latch is in the bolted position, the coupling element is disengaged with the pawl.

16. The motor vehicle door latch according to claim 1, wherein when the coupling element is in an engaged position, the activation lever mechanism provides a continuous mechanical connection from the external door handle to the locking mechanism, and wherein when the coupling element is in a disengaged position, the activation lever mechanism does not have a continuous mechanical connection from the external door handle to the locking mechanism.

17. The motor vehicle door latch according to claim 16, wherein when the coupling element is in the engaged position, the bolting unit is in an unbolted position, and wherein when the coupling element is in the disengaged position, the bolting unit is in a bolted position.

18. The motor vehicle door latch according to claim 17, wherein the securing device includes a securing lever that impinges the coupling element to move the coupling element into the engaged position and the disengaged position.

19. The motor vehicle door latch according to claim 1 further comprising a sensor that is configured to determine a position of the securing device and whether the activation lever mechanism is in an enabled or disabled state.

* * * * *